US005927690A

United States Patent [19]

White et al.

[11] Patent Number: 5,927,690

[45] Date of Patent: Jul. 27, 1999

[54] PUSH-PULL CHAIN DRIVE DOOR OPERATOR SYSTEM

[75] Inventors: James A. White, Louisville; Nicholas Dragomir, Alliance; James Stottsberry, Massillon, all of Ohio

[73] Assignee: Overhead Door Corporation, Dallas, Tex.

[21] Appl. No.: 08/857,869

[22] Filed: May 16, 1997

[51] Int. Cl.[6] ..... B66D 1/12; B66D 1/14

[52] U.S. Cl. ..... 254/343; 160/201; 254/374; 254/362; 254/382

[58] Field of Search ..... 254/265, 343, 254/374, 372, 362, 382, 389; 160/201

[56] References Cited

U.S. PATENT DOCUMENTS

| | | | |
|---|---|---|---|
| 1,807,466 | 5/1931 | Birkenmaier | 254/382 |
| 2,286,388 | 6/1942 | Smith | 254/382 |
| 2,560,236 | 7/1951 | McNinch et al. . | |
| 3,193,274 | 7/1965 | Miller . | |
| 3,465,371 | 9/1969 | Schweitzer | 254/362 |
| 4,311,225 | 1/1982 | Tsubaki et al. . | |
| 4,414,778 | 11/1983 | Carli . | |
| 4,520,684 | 6/1985 | Meyer et al. . | |
| 4,984,387 | 1/1991 | Wheatland . | |
| 5,188,163 | 2/1993 | Schwartzengraber et al. | 160/201 |

FOREIGN PATENT DOCUMENTS

| | | |
|---|---|---|
| 0563517 | 1/1993 | European Pat. Off. . |
| 4210523 | 3/1992 | Germany . |
| 4425371 | 7/1994 | Germany . |

*Primary Examiner*—Katherine Matecki

*Attorney, Agent, or Firm*—Akin, Gump, Strauss, Hauer & Feld, L.L.P.

[57] ABSTRACT

A push-pull chain garage door operator system includes a drive module and an elongated guide rail for a push-pull chain connected to a carriage assembly mounted on the guide rail. The chain is engaged with a sprocket mounted on a generally rectangular plate-like molded plastic support member which includes a serpentine idle chain storage slot formed therein. The support member is releasably connected to a stamped metal frame plate for covering the storage slot and supporting the drive module. The bottomwall of the support member supports a right angle speed reduction drive unit connected to a drive motor retained in a cradle formed by an integral boss on the support member. The motor and a starting capacitor therefor are retained in respective cradle portions of the boss by a removable retaining strap. A control circuit board is mounted on the underside of the support member and a two-part shroud for the operator mechanism is releasably secured to the frame plate.

24 Claims, 7 Drawing Sheets

PUSH-PULL CHAIN DRIVE DOOR OPERATOR SYSTEM

FIELD OF THE INVENTION

The present invention pertains to an operator system for opening and closing an upward acting door, including an electric motor drive mechanism for moving a push-pull chain between a chain storage magazine and a guide rail which supports a carriage assembly connected to the chain and to the door.

BACKGROUND

A variety of upward acting garage door and similar closure member operator systems have been developed. One type of system which has certain advantages utilizes a flexible member, such as a roller-type chain, which is guided in a channel extending within an elongated support rail, which supports a carriage member connected to the door. The chain is trained over a drive sprocket which is drivenly connected to an electric motor for moving the chain and carriage along the rail to move the door between open and closed positions. When the door is in the open position, a substantial portion of the chain is "idle" and must be stored in a suitable storage structure or magazine.

Although this type of door operator mechanism has certain advantages, there has been a need to improve and further develop this type of mechanism to enhance its desirability for use as a door operator for residential garage doors and the like, in particular. For example, certain improvements in the arrangement of the idle chain storage magazine have been sought while providing a low-cost, easily fabricated, compact magazine structure and while still providing adequate support structure for training the push-pull chain in and out of the magazine and in the vicinity of a chain drive sprocket, in particular.

Improvements have also been sought in the overall arrangement of the drive motor, speed reduction gear drive mechanism and means for supporting the motor on a frame or main support member of the operator system, which support member also desirably includes the chain storage magazine. Still further, there is the ever-present need to produce a reliable, suitably operable system at reduced cost without sacrificing durability, simplicity of manufacture and servicing, and other parameters normally considered desirable in appliances which receive frequent use but do not normally receive careful maintenance. It is to these ends that the present invention has been developed.

SUMMARY OF THE INVENTION

The prevent invention provides an improved operator system, particularly of a type which includes a flexible push-pull member guided along an elongated support rail and drivingly connected to a motor for opening and closing an upward acting garage door and the like.

In accordance with one aspect of the invention, a push-pull chain drive door operator system is provided with an improved, compact, idle chain storage magazine. In particular, the chain storage magazine includes a serpentine channel formed in a main support member of the system, which member is preferably formed of a moldable polymer material, and also forms a support for the operator drive motor and associated speed reducing transmission mechanism. The chain storage magazine and support member also provides an improved support arrangement for the operator drive motor, which minimizes unwanted forces acting on the motor and its output shaft.

In accordance with another aspect of the invention, a push-pull chain drive door operator system is provided with an improved support structure for the drive motor, the chain drive sprocket, the idle chain storage magazine, and the chain guide rail, which structure includes a molded polymer support member and a formed metal plate frame and cover member, which is easily connected to the support member and provides a high-strength connection between the aforementioned support member and the elongated chain guide rail.

In accordance with yet another aspect of the invention, a push-pull chain drive door operator system is provided which includes a chain drive sprocket mounted on a support member which also includes the idle chain storage magazine and which supports removable and replaceable chain stripper and chain race or guide members. The chain guide and stripper members are mounted on the support member, are formed of wear-resistant materials and are adapted to be easily replaced, if needed.

In accordance with still further aspects of the present invention a push-pull chain drive door operator system includes an improved arrangement of a support for the operator system control unit, a support for a lamp socket fixture and a unique combination of removable shroud or cover members for the operator system.

Those skilled in the art will further appreciate the above-mentioned advantages and superior features of the invention together with other important aspects thereof upon reading the detailed description which follows in conjunction with the drawings.

DESCRIPTION OF A PREFERRED EMBODIMENT

Figure 1:
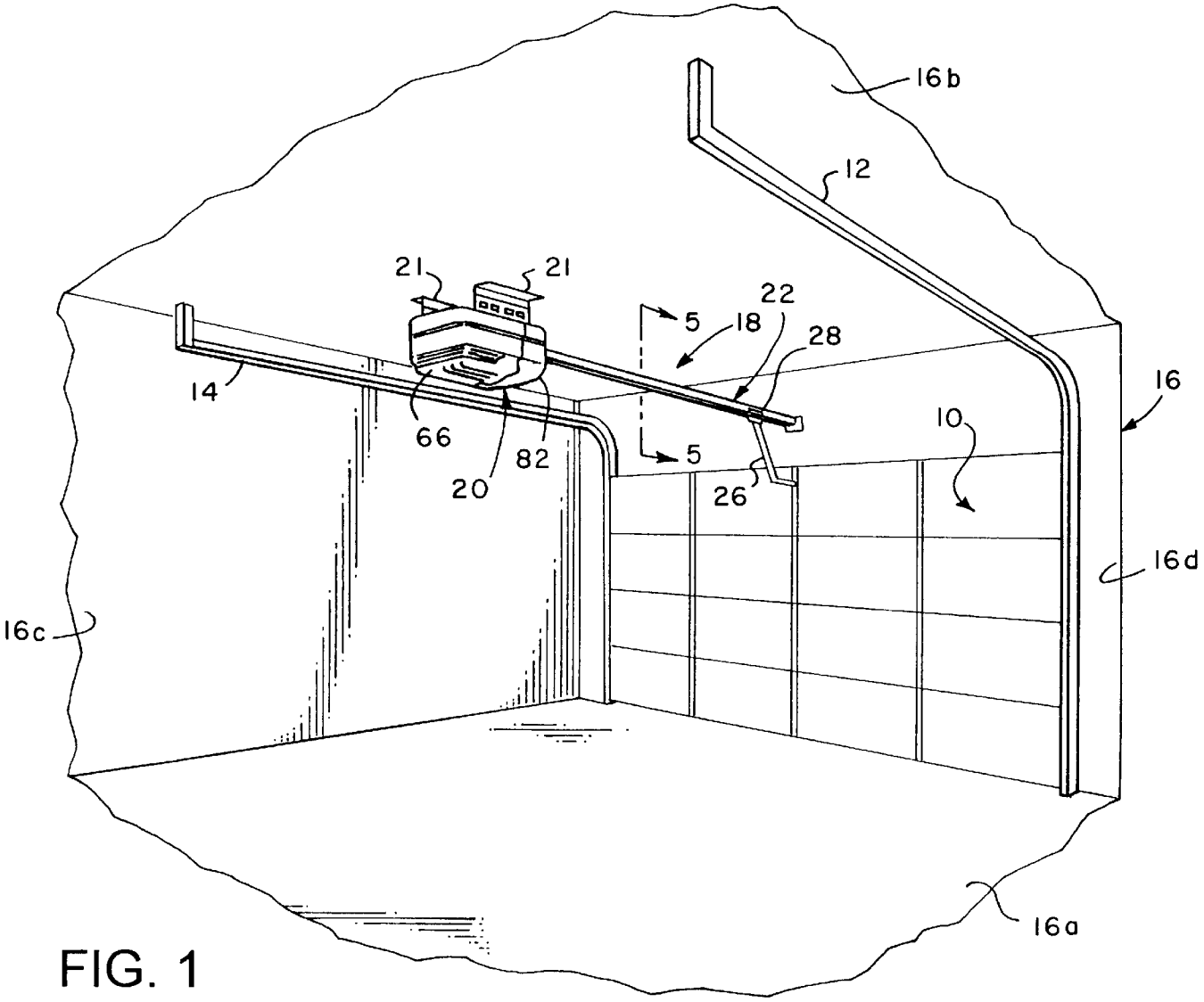
FIG. 1 is a perspective view of a door operator system in accordance with the invention.

In the description which follows, like parts are marked throughout the specification and drawing with the same reference numerals, respectively. The drawing figures are not necessarily to scale and certain features may be shown in generalized or schematic form in the interest of clarity and conciseness.

Referring to FIG. 1, there is illustrated a typical application for the operator system of the present invention comprising an upward acting sectional garage door, generally designated by 10, which is supported in a conventional manner by opposed spaced-apart guide tracks 12 and 14 for movement between open and closed positions to provide access to and from a garage 16. Garage 16 is defined, in part, by a floor 16*a,* ceiling 16*b,* a sidewall 16*c* and an endwall 16*d.* An improved door operator system in accordance with the invention is illustrated in FIG. 1 and generally designated by the numeral 18. The door operator system 18 includes a drive module 20 adapted to be supported by suitable brackets 21 connected to and depending from the ceiling 16*b.* The drive module 20 is suitably connected to an elongated guide and support rail 22, preferably formed of an extruded metal, such as aluminum, and having a configuration to be described in further detail herein. One end of the support rail 22 is suitably supported by the drive module 20 in a manner to be furthered described and the opposite end of the support rail 22 is also suitably supported by garage endwall 16*d* and directly above the sectional door 10 in its closed position. A conventional link or arm 26 is connected to the door 10 and to a carriage assembly 28, supported by the rail 22 and described further herein, for movement along the rail to move the door 10 between open and closed positions.

Figure 2:
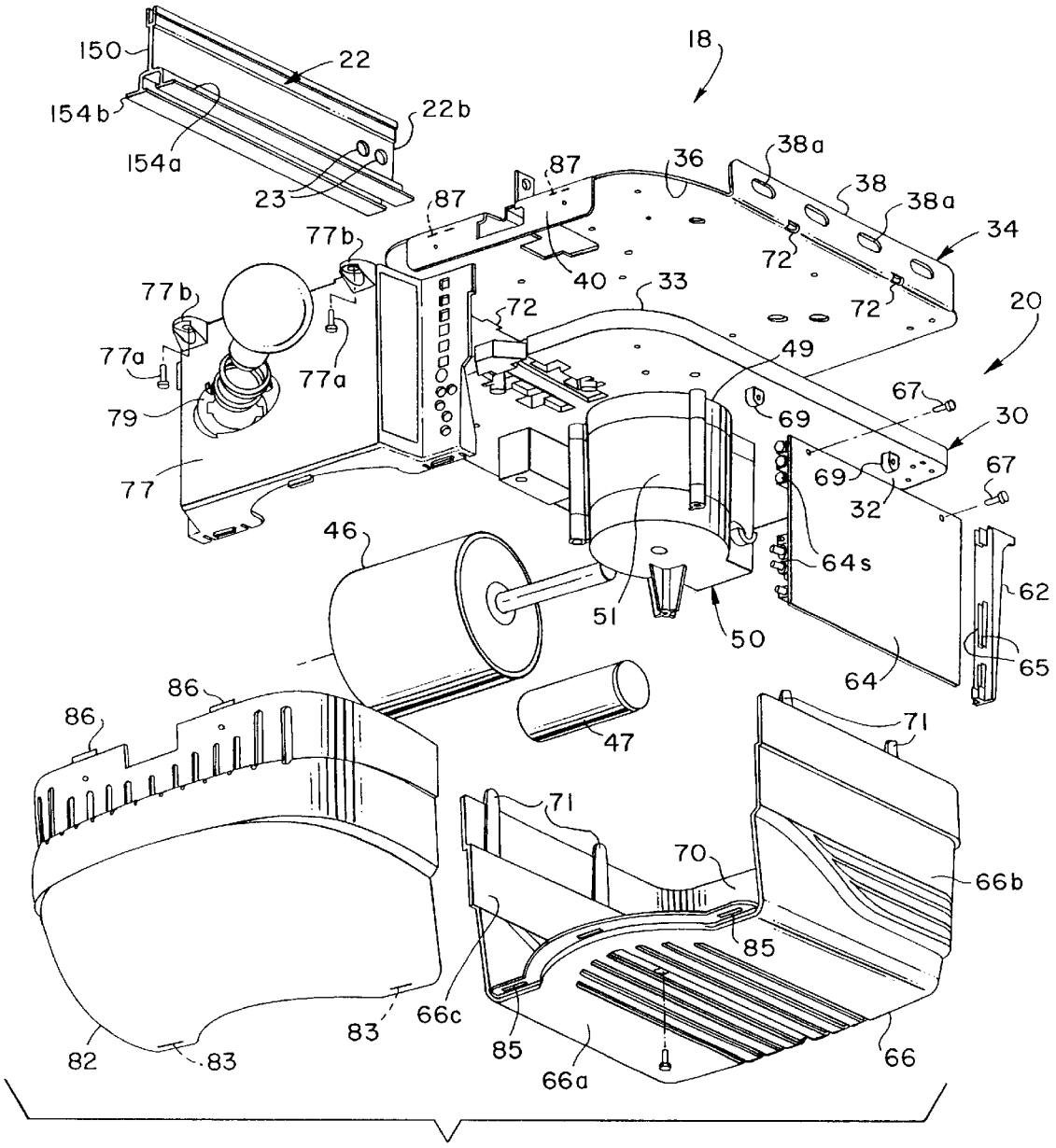
FIG. 2 is an exploded perspective view of the chain storage magazine and motor support member and associated components of the system shown in FIG. 1.

Referring now to FIG. 2, the drive module 20 is characterized by a generally rectangular, shallow, plate-like support member 30 having a planar bottomwall 32. The support member 30 is preferably formed of a molded polymer material, such as a type sold under the trademark VALOX by General Electric Company, Pittsfield, Mass. The support member 30 is adapted to be releasably connected to and supported by a stamped or otherwise formed metal plate frame member 34, having a generally planar cover portion 36 adapted to be contiguous with an upper support surface 33 of the support member 30. The frame member 34 has opposed upturned longitudinal side flanges, 38 and 39 (see FIG. 7, also) and a downwardly turned transverse end flange 40. The flanges 38 and 39 include respective elongated slots 38*a,* FIG. 2, and 39*a,* FIG. 7, formed therein, respectively, for connecting the flanges to the respective support brackets 21, shown in FIG. 1, in a suitable manner.

Figure 7:
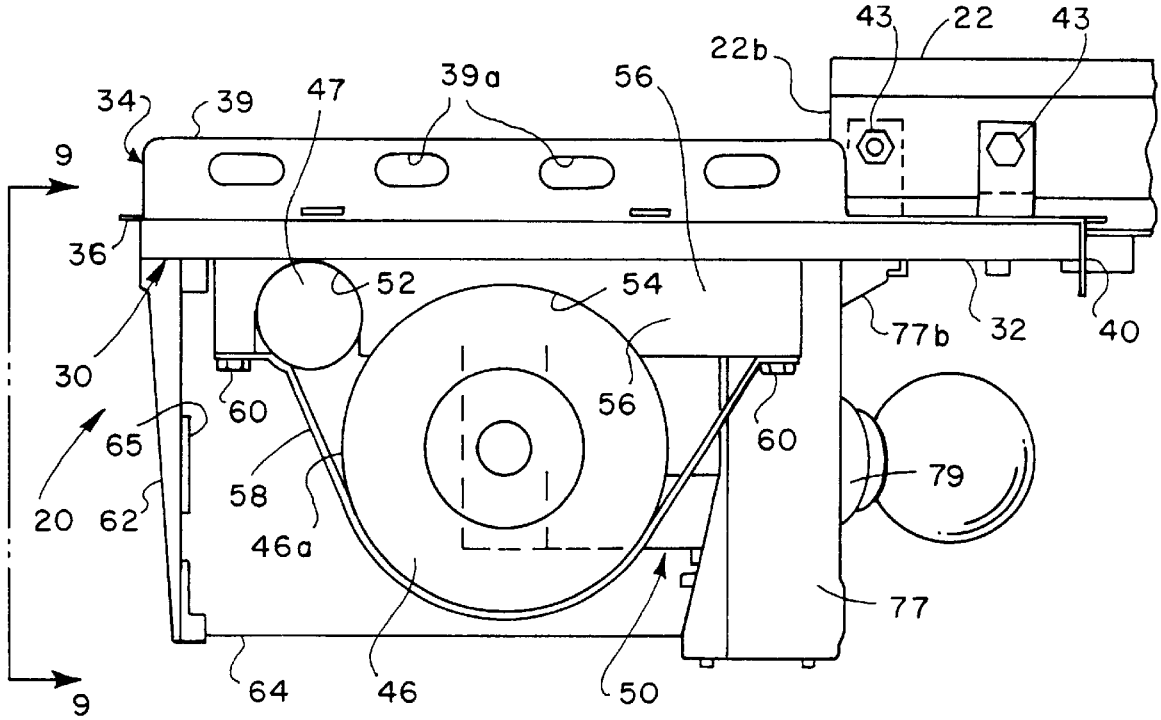
FIG. 7 is a detail side elevation showing the mounting arrangement for the operator drive motor and its starting capacitor.
Figure 8:
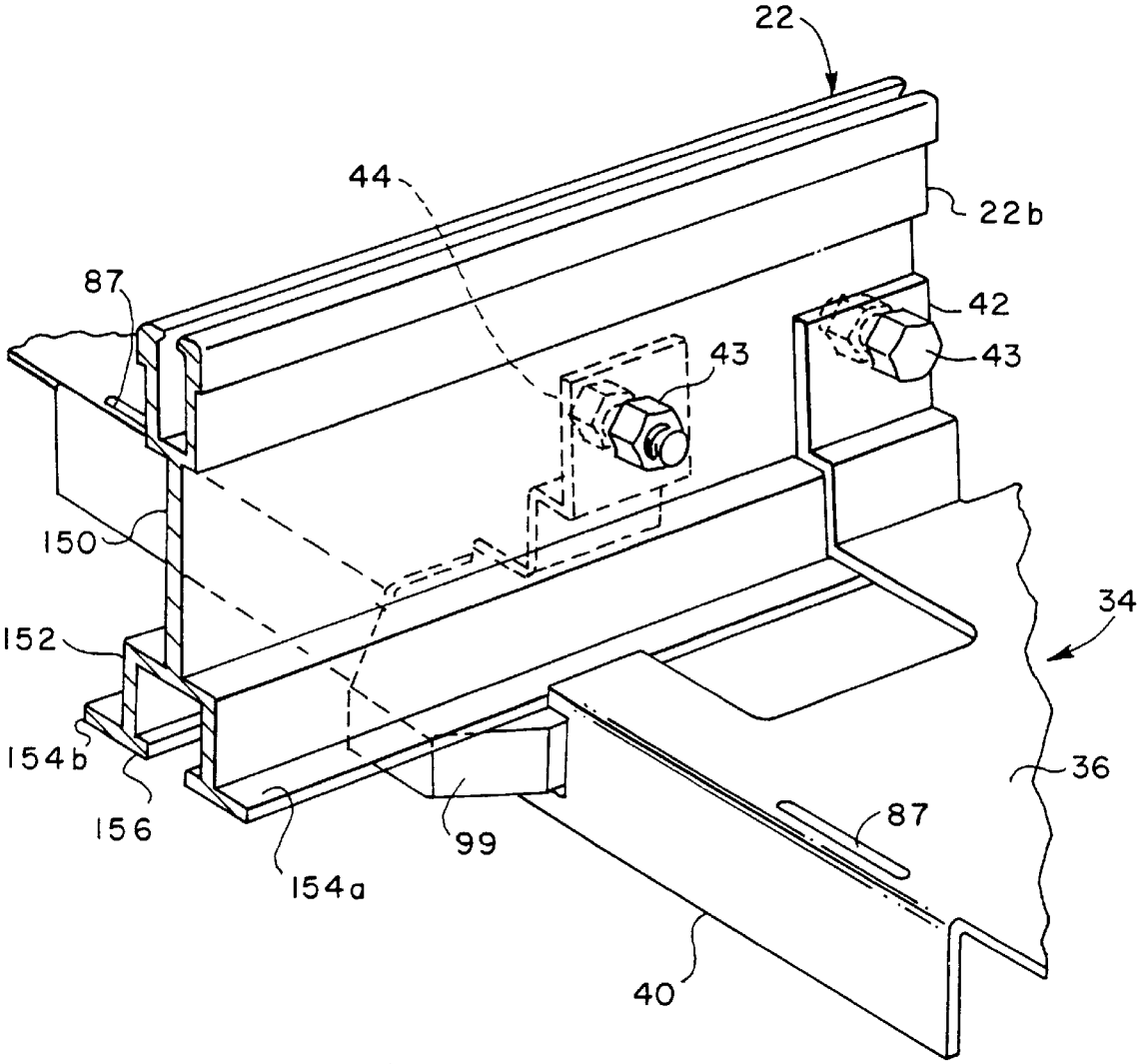
FIG. 8 is a detail perspective view showing the connection between the chain guide rail and the frame plate.

Referring further to FIGS. 7 and 8, in particular, the frame plate 34 is also provided with formed, upstanding spaced-apart and opposed tabs 42 and 44, generally centrally located between the opposed side flanges 38 and 39 and operable to be releasably connected to one end of the guide rail 22 by conventional threaded fastener assemblies 43 which include portions operable to be projected through fastener receiving bores 23, see FIG. 2, formed adjacent one end 22*b* of guide rail 22. The tabs 42 and 44 are also adapted to conform to opposed side flanges of the guide rail 22, as illustrated.

As further shown in FIG. 2, the operator 18 includes a drive mechanism characterized by an AC electric motor 46 having a rotary output shaft 48 which is operable to be drivingly-connected to a speed reducing gear transmission unit 50. Unit 50 is preferably mounted on a boss 49 formed integral with and projecting from the bottomwall 32 of the support member 30 by conventional fasteners, not shown. The boss 49 preferably has a shape conforming to that of an enclosure 51 for unit 50. The speed reducing unit 50 is preferably a worm-gear drive and incorporates a conventional worm, having a suitable bore formed therein for receiving the motor shaft 48, and mounted within the enclosure 51 for the unit 50.

Figure 9:
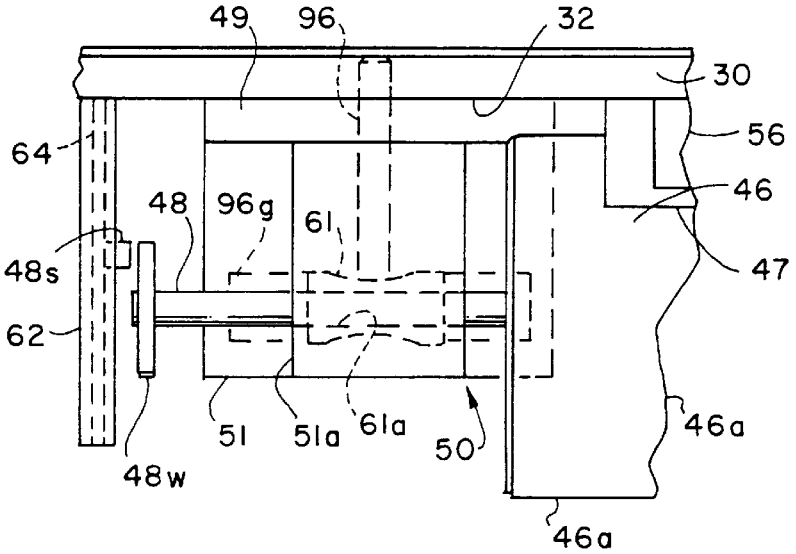
FIG. 9 is a detail view taken generally from line 9—9 of FIG. 7.

Referring now to FIGS. 7 and 9, and FIG. 7, in particular, the support member 30 includes spaced-apart arcuate recesses 52 and 54 formed in an elongated generally rectangular boss 56 formed integral with and projecting from the bottomwall 32 of the support member 30. A support strap 58 is releasably connected to the boss 56 at opposite ends by conventional fasteners 60, as shown, and retains the motor 46 in the recess 54 and a motor capacitor 47 in the recess 52. The motor 46 and its capacitor 47 may be easily removed from the recesses formed in the boss 56 by removing the strap 58 whereby the capacitor 47 may be replaced, if needed, and the motor 46 may be removed for servicing and/or replacement, also if needed.

Referring to FIG. 9, in particular, the motor shaft 48 is shown projecting through a portion 51*a* of enclosure 51 and is drivably engaged with the aforementioned worm 61 suitably mounted for rotation in the enclosure 51, 51*a.* Thanks to the arrangement of the boss 56 and the recess 54, together with the motor support strap 58, the motor 46 is mounted for driving engagement with the worm 61 without imposing any axial forces on shaft 48 thereby alleviating any unwanted bearing loads on the shaft. Shaft 48 has a suitable cross sectional configuration or may be provided with suitable key means cooperable with a bore 61*a* of worm 61 whereby the shaft is axially slidable in the bore but is not rotatable relative to worm 61. Moreover, by controlling the dimensions of the support member 30 and the speed reduction drive unit 50, the shaft 48 is properly aligned with the worm 61 when the motor housing 46*a* is engaged with the recess 54 and retained therein by the strip 58. The distal end of motor shaft 48 also supports a removable encoder wheel 48*w* which is operable to provide suitable signals to a control system for the operator 18. In this regard a sensor 48*s* is shown mounted on a circuit board 64 suitably supported on the support member 30 in a manner to be described in further detail herein.

Referring again to FIG. 2, the support member 30 also includes a depending bracket 62 suitably connected thereto for supporting control circuit board 64 thereon. The board 64 may be supported on the bracket 62 by integrally-formed spaced-apart upstanding flanges 65 forming a board receiving channel therebetween, respectively. The board 64 is also connected to support member 30 by suitable fasteners 67 engageable with cooperating bosses 69 projecting from bottomwall 32.

As further shown in FIG. 2, a molded one-piece shroud member 66 includes a bottomwall 66*a,* opposed sidewalls 66*b* and 66*c* and one transverse endwall 70. Integral support and retainer tabs 71 are formed on the sidewalls 66*b* and 66*c* and are operable to project into spaced apart tab receiving slots 72 formed in the frame plate 34.

Still further, the drive module 20 for the operator 18 includes a separate support 77 for a lamp fixture or socket 79 and for suitable control switches 64*s* for the circuit board 64. The support 77 is adapted to be secured to the bottomwall 32 of the support member 30 by conventional fasteners 77*a* which are operable to project through suitable fastener receiving bores in integral spaced-apart bosses 77*b* formed on the support 77.

A second, translucent shroud member 82 is provided for the drive module 20 and includes spaced-apart retainer tabs 83 which are engageable with shroud member 66 at cooperating slots 85 formed in the shroud member. Shroud member 82 also includes retainer tabs 86 which are operable to project through slots 87 formed in the frame plate 34, as shown in FIGS. 2 and 8. Accordingly, the entire workings of the module 20 which are supported on the underside of the support member 30 may be easily accessed upon removing the shroud members 66 and 82. Each of the retainer tabs 72, 83 and 86 may have suitable integrally-molded hook portions formed thereon, not shown, which cooperate with side edges of the slots into which they are inserted to suitably retain the shrouds connected to the frame plate 34, but the tabs may be easily deflected to disconnect the shroud members from each other and the frame plate 34.

Figure 3:
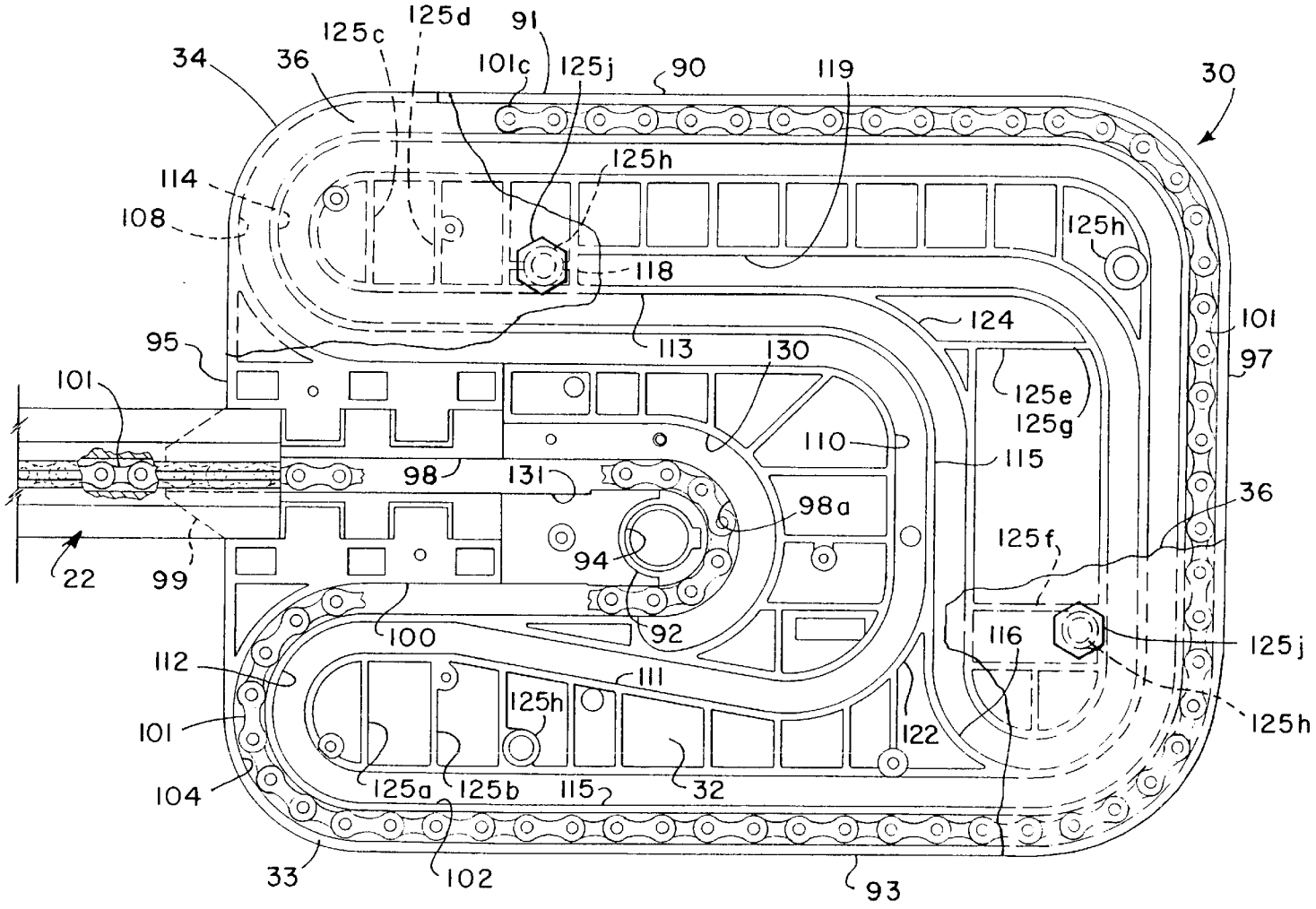
FIG. 3 is a plan view of the chain storage magazine and support member showing the serpentine idle chain storage slot or channel.

Referring now to FIG. 3, there is illustrated a top plan view of the support member 30. As previously mentioned, the support member 30 is preferably formed of molded polymeric material, such as a VALOX polyester resin. The support member 30 is defined by the bottomwall 32, by a peripheral, upstanding outer sidewall 90 and by a boss 92 which extends from the bottomwall 32 toward the top surface 33, the surfaces 32 and 33 being substantially parallel. The boss 92 is substantially centrally disposed between opposite longitudinal side edges 91 and 93 and between opposed transverse edges 95 and 97 of the support member 30. A stepped bore 94 is formed in boss 92, substantially perpendicular to and extending through the bottomwall 32 for receiving a rotatable output drive shaft 96, see FIGS. 6 and 9, of the speed reducing drive unit 50. Shaft 96 is drivenly connected to a gear 96*g*, FIG. 9, disposed in enclosure 51 and meshed with worm 61.

A chain guide channel 98 extends substantially tangentially from the boss 92 and longitudinally on support member 30 to the endwall 95 and extends through a longitudinally extending projection or bumper 99 protruding from the lateral edge 95, for a purpose to be described in further detail herein. The longitudinal chain guide channel 98 extends to the boss 92 and then enters a semicircular, switch-back bend portion 98*a* of the channel which is adjacent to and communicates with an elongated serpentine channel 100 formed on the member 30 and forming a storage space for idle chain of the operator 18.

The serpentine channel 100 is defined in part by the peripheral sidewall 90 and by an intermediate wall 102. The channel 100 includes a first semicircular switch-back portion 104 which redirects the channel to substantially follow the peripheral sidewall 90 along side edge 93 to the transverse side edge 97 of the support member 30, then along side edge 97 to opposite longitudinal side 91, then along side edge 91 and to a second semicircular switch-back portion 108. The serpentine channel 100 then loops around the boss 92 at a channel portion 110 and commences an inner storage channel portion including a section 111 connected to a switch-back portion 112. Inner channel 111 follows the intermediate wall 102 and the outer channel 100 around to a fourth switch-back portion 114, then to a portion 115 parallel to section 110, and finally into a reverse loop, including a switchback portion 116. The storage channel 100, 111 terminates at a channel endwall 118 at the end of a terminal section 119 parallel to side edges 91 and 93.

Accordingly, by arranging the support member 30, as shown, with the bore 94 for receiving the chain sprocket drive shaft 96 substantially centrally located between opposite ends and opposite sides of the support member, a substantial length of idle chain storage slot or channel may be formed by a serpentine path including inner and outer loops of the channel and a final reverse loop formed, all formed on the support member. The chain storage channel 100, 104, 108, 110, 111, 112, 114, 115, 119 and the chain inlet channel 98 are substantially coplanar and within the confines of the support member 30 between the bottomwall 32 and the parallel top surface 33. The inner loop of the channel defined in part by the switch-back portions 112 and 114, as well as longitudinal run portions, 113 and 115, is also defined by a substantially continuous inner wall 122 which, together with a wall 124, also defines the loop 116. Suitable reinforcing ribs extend between the walls forming the chain storage channel, as indicated by way of example at 125*a*, 125*b*, 125*c*, 125*d*, 125*e*, and 125*f*. An opening 125*g* in the bottomwall 32 is formed between the reinforcing ribs 125*e* and 125*f*. Additional reinforcing ribs are illustrated in FIG. 3 but are not identified by reference numerals in the interest of brevity. Spaced apart bosses 125*h* are provided for receiving suitable threaded fasteners 125*j*, two shown, for securing frame member 34 to the support member 30, as shown in FIG. 3.

Figure 4:
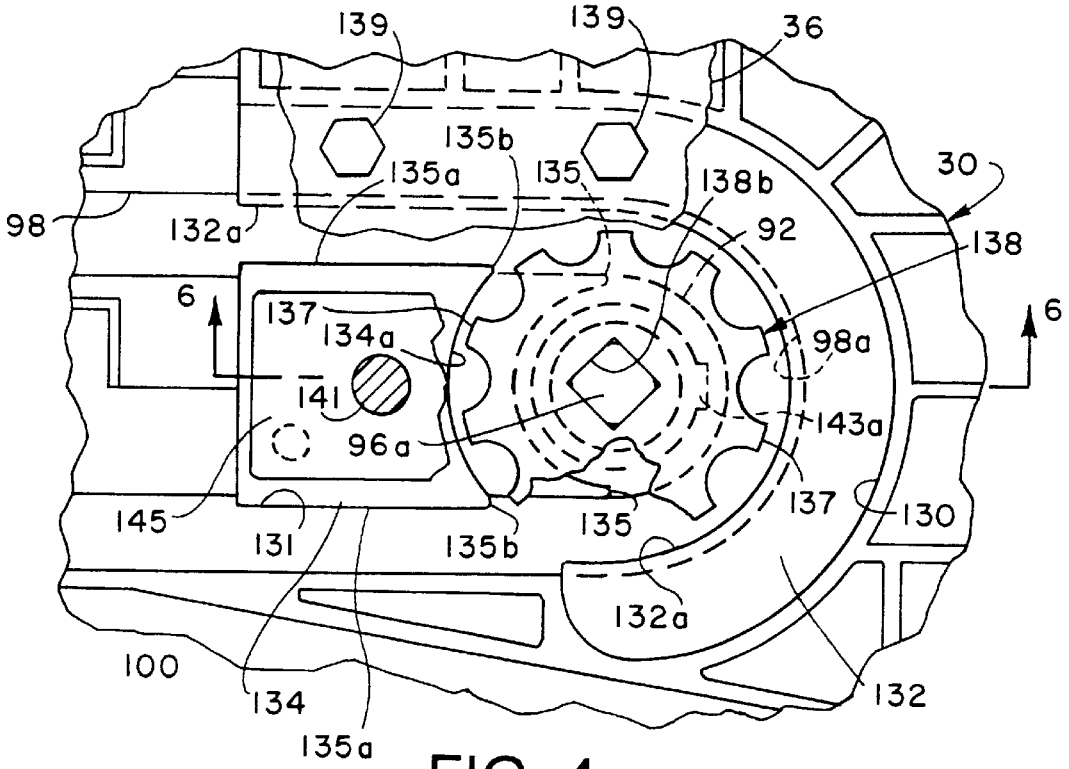
FIG. 4 is a detail plan view on a larger scale showing the chain guide and stripper members on the support member.
Figure 6:
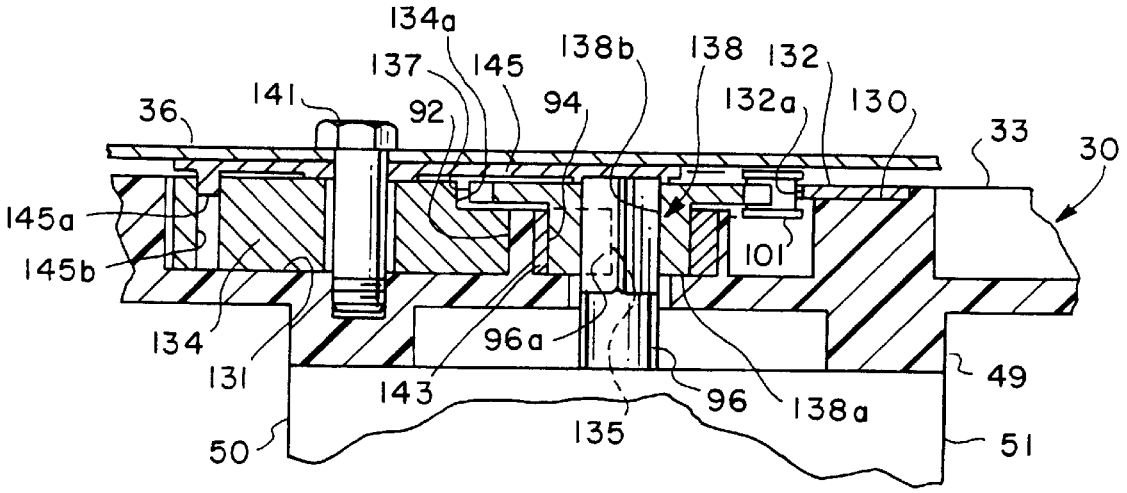
FIG. 6 is a section view taken from the line 6—6 of FIG. 4.

As shown in FIGS. 3, 4 and 6, a shallow, somewhat U-shaped recess 130 is formed in the surface 33 of support member 30) and is adapted to receive a somewhat U-shaped, generally flat plate-like chain guide or race member 132. The chain guide 132 is preferably formed of an abrasion and wear-resistant material, such as hotrolled and oiled, case hardened steel, and includes a chain guide surface 132*a* disposed adjacent the channel portions 98 and 100 at the switch-back portion 98*a*. Chain guide 132 assists in maintaining chain 101 engaged with a toothed chain drive sprocket 138 and also prevents forcible engagement of the chain with the channel wall defining channel section 98*a*, in particular.

Still further, as shown in FIGS. 4 and 6, a substantially flat, plate-like chain stripper member 134 is supported on the support member 30 in a recess 131 adjacent the boss 92 and on the opposite side of the switch-back portion 98*a* of the chain guide channel from the chain guide 132. The chain stripper 134 is characterized by spaced apart parallel primary stripper fingers 135 disposed as shown in FIG. 4. The chain stripper 134 also includes opposed parallel projections 135*b*. The fingers or projections 135 and the projections 135*b* are disposed adjacent the roots and tips, respectively, of spaced apart teeth 137 of chain sprocket 138 mounted on the shaft 96. Chain guide and stripper surfaces 135*a* and projections 135 and 135*b* are operable to cause the chain 101 to move out of engagement with the sprocket 138 as it enters the channels 98 and 100, respectively, from channel portion 98*a*. The chain guide 132 and the chain stripper 134 are both removably supported on the support member 32 by suitable threaded fasteners 139 and 141, as shown in FIGS. 4 and 6.

The sprocket 138 includes a cylindrical hub portion 138*a* which is journaled by a bearing bushing 143, FIG. 6, disposed in the bore 94. Bushing 143 includes a key portion 143*a*, FIG. 4, operable to be received in a corresponding key slot intersecting the bore 94 to retain the bushing 143 against rotation within the bore. The hub 138*a* includes a square cross-section bore 138*b* for receiving a corresponding square cross-section drive tang 96*a* on the distal end of driveshaft 96. Sprocket 138 is retained in bearing bushing 143 by a spacer plate 145 including a locating boss 145*a* which projects into a bore 145*b* in chain stripper 134 to properly locate the spacer plate during assembly of the operator 18. As shown in FIG. 6, fastener 141 is operable to secure the spacer plate 145 as well as the chain stripper 134 on the support member 30.

Accordingly, when the portion of the chain 101 extending within the channel 98 is being pushed or pulled through the channel and the guide rail 22, the chain guide 132 engages the chain to prevent forcible engagement of the chain with the sidewalls of the channel portion 98*a*, in particular. The chain stripper 134 also assures that the chain 101 will disengage from the drive sprocket 138 at substantially the points of tangency of the longitudinal centerline of the channels 98 and 100 with the pitch circle of the sprocket teeth 137 to properly guide chain 101 on and off of the sprocket 138 and to minimize forcible engagement of the chain with the channel walls. Chain stripper 134 is preferably formed of a pre-lubricated, wear-resistant material, such as case hardened steel. Due to the confinement of the chain 101 between the chain stripper 134 and the guide 132, the sprocket teeth 137 are preferably truncated about thirty to forty percent less than normal tooth height for roller chain sprockets to provide for ease of release of the chain from the sprocket.

Figure 5:
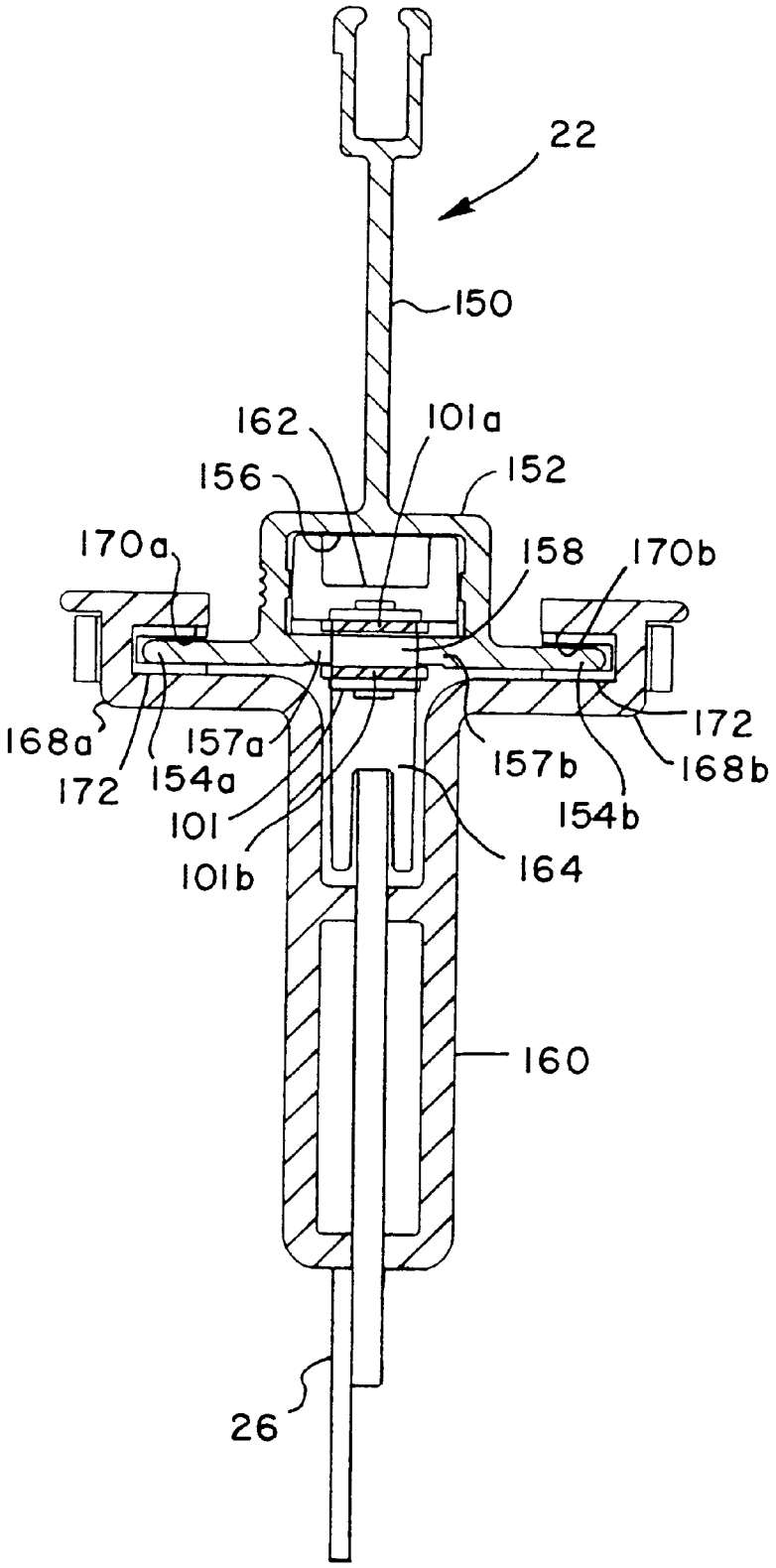
FIG. 5 is a section view taken from the line 5—5 of FIG. 1.

Referring now to FIG. 5, the guide rail 22 is characterized as an elongated member, preferably formed of extruded aluminum or the like, and comprising a generally planar web portion 150, an enlarged cross-section portion 152 and opposed flanges 154*a* and 154*b* extending substantially normal to the web portion 150. The enlarged rectangular cross-section portion 152 forms a guide channel or slot 156 which is partially closed by opposed reentrant flange portions 157*a* and 157*b*, defining a space 158 therebetween for receiving the chain 101. The chain 101 is confined in the space or slot 158 by the flange portions 157*a* and 157*b*, which are engageable with opposed parallel chain plates 101*a* and 101*b* of the chain 101.

The distal end of the chain 101 is connected to a carriage member 160 by a bracket member 162 disposed in the channel 156 and engageable with a carriage slide member 164. Carriage slide 164 is connected to the carriage 160 and to the arm 26 in a conventional manner and may have a configuration similar to that shown in U.S. Pat. Nos. 4,414,778 issued Nov. 15, 1983 to Carli and 4,520,684 issued Jun. 4, 1985 to Meyer et al. and assigned to the assignee of this invention. The carriage 160 includes opposed arm portions 168*a* and 168*b*, which form parallel slots 170*a* and 170*b*, respectively, which receive the flanges 154*a* and 154*b*. Suitable channel shaped bearing inserts 172 may be retained in the slots 170*a* and 170*b* for low friction sliding engagement with the flanges 154*a* and 154*b*.

The chain 101 extends from its aforementioned distal end, which is connected to members 162, 164, within the slot 158, supported by the guide rail 22 and through the channel 98 to engagement with the sprocket 138 and then through the serpentine channel 100 formed in the member 30 to an opposite distal end 101*c* shown in FIG. 3. A sufficient length of chain 101 is provided such that, when the door 10 is in the closed position shown, the chain is still fully engaged with the sprocket 138 and the distal end 101*c* is at least in the storage channel 100 between the sprocket and the switchback portion 104. However, when the operator 18 is energized to rotate the sprocket 138 to pull the chain 101 along the guide rail 22 to effect opening movement of the door 10, the distal end 101*c* of the chain slides through the serpentine storage channel 100 as the idle portion of the chain coming off the sprocket increases in length. Thanks to the compact arrangement of the serpentine idle chain storage channel shown and described, a substantial length of idle chain 101 may be stored in a compact manner within the support member 30 and the chain is not required to be stacked in a spiral fashion as with prior art chain storage magazines.

As the carriage 160 moves toward the projection 99, if the control system for the operator 18 does not de-energize the motor 46 at a predetermined point, the projection 99 may be relied on to arrest movement of the carriage and the door in the open position thereof and suitable motor controls responsive to signals generated by the encoder wheel 48*w* and sensor 48*s* may be utilized to effect de-energizing the motor before chain tension is increased to a point which may damage the chain 101, the sprocket 138 or any portion of the support member 30. The projection 99 also avoids the carriage 160 forcibly engaging the endwall 95 of the support member 30 and inflicting unwanted damage thereon. Still further, if idle chain has taken up substantially all of the storage channel length at the point of engagement of the carriage assembly with the projection 99, the projection prevents further travel of the chain into the channel and possible forcible extrusion of the chain through one of the channel walls or the bottomwall 32 of the support member 30.

The construction and operation of the operator 18 is believed to be within the purview of one of ordinary skill in the art based on the foregoing description. The components not described in detail herein may be constructed using conventional engineering materials and practices known to those of skill in the art of door operator systems. When the motor 46 is energized for rotation in one direction, the sprocket 138 will push the chain 101 through the slot 98 and along the guide rail 22, while the chain is constrained within the slot 158 by the flange portions 157*a* and 157*b*, to move the carriage assembly 160 and the door 10 from an open position to a closed position. The wear-resistant chain guide 132 prevents unwanted disengagement of the chain from the sprocket 138 while the chain stripper 134 provides for disengagement of the chain at the desired points of tangency with the chain slots 98 and 100, respectively. Either of the components 132 and 134 may be removed and replaced if damaged or worn without requiring replacement of the support member 30. The chain 101 may be coated with a suitable lubricant which is compatible with the material of which the support member 30 as well as the guide rail 22 are fabricated, respectively.

When the motor 46 and sprocket 138 are rotated in the opposite direction from that just described, the sprocket 138 pulls the chain 101 into the slot or channel 98 from the guide rail 22 and idle chain is pushed along the serpentine storage channel or slot 100, 104, 108, 110 and so on, whereby a substantial portion of idle chain may be conveniently stored in a compact manner without requiring distortion or unwanted increase in friction forces acting on the chain. Moreover, the combined support member and storage magazine 30 together with the frame plate 34 forms a rigid support structure for the operator 18 which may be easily assembled and disassembled for any intended purpose. Still further, the arrangement of the operator motor 46 and the speed reduction drive unit 50 mounted on the underside or bottomwall 32 of the support member 30 provides easy access to these components as well as to the control circuit board 64, upon removal of the shroud members 66 and 82, without removing the drive module 20 from its installed position. Still further, the two-part snap-on and snap-off shroud members 66 and 82 provide a convenient, easily removable cover structure for the operator 18.

Although a preferred embodiment of the invention has been described in detail herein. Those skilled in the art will also appreciate that various substitutions and modifications may be made without departing from the scope and spirit of the appended claims.

What is claimed is:

1. An operator system for opening and closing a movable barrier comprising:

an elongated guide rail including a longitudinal slot formed therein;

a carriage member supported on said guide rail for sliding movement therealong, said carriage member being operably connected to said movable barrier;

a flexible elongated member connected to said carriage member and disposed for movement along said guide rail and confined for longitudinal sliding movement in said slot in said guide rail;

a drive module including a support member operably connected to one end of said guide rail, said support member defining an elongated serpentine storage channel for an idle portion of said flexible elongated member;

a rotatable sprocket disposed on said drive module and engageable with said flexible elongated member for pushing and pulling said flexible elongated member along said guide rail to move said barrier between open and closed positions;

said support member including a guide channel for said flexible elongated member extending between said guide rail and said sprocket, a first switchback portion of said storage channel, and a second switchback portion of said storage channel spaced from said first switchback portion whereby said guide channel is disposed between said first and second switchback portions;

a frame plate releasably secured to said support member and covering said channels and including means for connecting said operator system to a support structure; and a drive motor mounted on said drive module and drivably connected to said sprocket for traversing said flexible elongated member along said guide rail to move said barrier between open and closed positions.

2. The operator system set forth in claim 1 including:

a guide member for said flexible elongated member releasably mounted on said support member adjacent said sprocket and operable to engage said flexible elongated member to maintain said flexible elongated member engaged with said sprocket.

3. The operator system set forth in claim 1 including:

a stripper member releasably mounted on said support member adjacent said sprocket for engagement with said flexible elongated member to release said flexible elongated member from said sprocket at a predetermined point thereon.

4. The operator system set forth in claim 1 wherein:

said storage channel includes a portion extending substantially parallel to said guide channel and said support member includes an arcuate channel portion interconnecting said guide channel and said storage channel adjacent said sprocket whereby said flexible elongated member is trained around said sprocket for engagement therewith over a substantially semi-circular arc.

5. The operator system set forth in claim 1 wherein:

said storage channel includes a first outer serpentine run including elongated spaced-apart parallel portions, a portion generally normal to said parallel portions and said first and second switch-back portions for reversing the direction of said storage channel and a second inner serpentine channel portion formed on said support member within said first serpentine channel and including opposed parallel run portions and at least two switch-back portions.

6. The operator system set forth in claim 5 wherein:

said first and second switch-back portions of said inner channel portion are adjacent said first and second switch-back portions of said outer channel portion for storing an idle portion of said flexible elongated member therein.

7. The operator system set forth in claim 6 wherein:

said storage channel portions for said flexible elongated member are formed integral with said support member.

8. The operator system set forth in claim 1 wherein:

said support member comprises a generally planar bottomwall and a spaced-apart, generally parallel planar top surface releasably engageable with said frame plate.

9. The operator system set forth in claim 8 wherein:

said frame plate comprises a generally flat plate member having opposed upturned flange portions for connecting said frame plate to said guide rail.

10. An operator system for opening and closing a movable barrier comprising:

an elongated guide rail including a longitudinal slot formed therein;

a carriage member supported on said guide rail for sliding movement therealong, said carriage member being operably connected to said movable barrier;

an elongated flexible member connected to said carriage member and disposed for movement along said guide rail and confined for longitudinal sliding movement in said slot in said guide rail;

a drive module including a support member operably connected to one end of said guide rail, said support member defining an elongated serpentine storage channel for an idle portion of said elongated flexible member;

a rotatable sprocket disposed on said drive module and engageable with said elongated flexible member for pushing and pulling said elongated flexible member along said guide rail to move said barrier between open and closed positions;

a drive motor mounted on said drive module including an output shaft drivably connected to said sprocket for traversing said elongated flexible member along said guide rail to move said barrier between open and closed positions;

a speed reduction drive unit interposed said motor and said sprocket and supported on said support member including a gear member engaged with said output shaft; and a boss on said support member adapted to support said drive motor on said support member without forcibly biasing an output shaft of said drive motor axially in engagement with said gear member of said speed reduction drive unit.

11. The operator system set forth in claim 10 wherein:

said boss includes a cradle portion formed thereon for receiving said drive motor and a releasable strap for retaining said drive motor nested in said cradle portion.

12. An operator system for opening and closing a movable barrier comprising:

an elongated guide rail including a longitudinal slot formed therein;

a carriage member supported on said guide rail for sliding movement therealong, said carriage member being operably connected to said movable barrier;

an elongated flexible member connected to said carriage member and disposed for movement along said guide rail and confined for longitudinal sliding movement in said slot in said guide rail;

a drive module including a support member operably connected to one end of said guide rail, said support member defining an elongated serpentine storage channel for an idle portion of said elongated flexible member;

a rotatable sprocket disposed on said drive module and engageable with said elongated flexible member for pushing and pulling said elongated flexible member along said guide rail to move said barrier between open and closed positions;

a frame plate releasably secured to said support member and including means for connecting said operator system to a support structure;

a drive motor mounted on said drive module and drivably connected to said sprocket for traversing said elongated flexible member along said guide rail to move said barrier between open and closed positions;

a first removable shroud member including a bottomwall, opposed sidewalls, an endwall and spaced-apart projections engageable with said frame plate for releasably securing said first shroud member to said drive module; and a second removable shroud member including a light transmitting portion thereof and having opposed sidewalls and an endwall, said second shroud member including connector means thereon engageable with at least one of said first shroud member and said frame plate for releasably securing said second shroud member to said drive module.

13. The operator system set forth in claim 12 including:

a lamp fixture disposed on said support member in a position to be enclosed by said second shroud member when said second shroud member is engaged with said frame plate.

14. An operator system for opening and closing a movable barrier comprising:

an elongated guide rail including a longitudinal slot formed therein;

a carriage member supported on said guide rail for sliding movement therealong, said carriage member being operably connected to said movable barrier;

an elongated flexible member connected to said carriage member and disposed for movement along said guide rail and confined for longitudinal sliding movement in said slot in said guide rail;

a drive module including a support member operably connected to one end of said guide rail, said support member defining an elongated serpentine storage channel for an idle portion of said elongated flexible member;

a rotatable sprocket disposed on said drive module and engageable with said elongated flexible member for pushing and pulling said elongated flexible member along said guide rail to move said barrier between open and closed positions;

said support member includes a boss formed thereon and defining a bore for receiving a bearing bushing and said sprocket includes a hub portion journaled in said bearing bushing for rotation therein; and a drive motor mounted on said drive module and drivably connected to said sprocket for traversing said elongated flexible member along said guide rail to move said barrier between open and closed positions.

15. The operator system set forth in claim 14 including:

a spacer member disposed between said frame plate and said support member and operable to retain said drive sprocket drivably engaged with a shaft drivenly connected to said drive motor.

16. The operator system set forth in claim 14 wherein:

said elongated flexible member comprises a roller chain disposed in a guide channel formed in said support member adjacent said sprocket and in a portion of said storage channel formed in said support member and adjacent said sprocket and said support member includes a guide member disposed adjacent said sprocket including an arcuate guide surface formed thereon for guiding said chain within said channel while engaged with said sprocket.

17. The operator system set forth in claim 16 including:

a stripper member supported on said support member adjacent said sprocket and including opposed stripper fingers engageable with said chain for effecting disengagement of said chain from said sprocket at said guide channel and said storage channel, respectively.

18. In an operator system for opening and closing a movable barrier, such as an upward-acting garage door and the like, a drive module engageable with an elongated flexible chain for driving said chain to move said barrier between open and closed positions, said drive module including:

a support member for said chain and for a drive motor drivably engageable with said chain for effecting movement of said barrier between open and closed positions, said support member comprising a generally rectangular plate-like member formed of a molded polymer and including an integral elongated serpentine storage channel formed therein for storing an idle portion of said chain, said support member including means for supporting a rotatable drive sprocket drivenly connected to said drive motor and engageable with said chain, a boss formed on said support member for supporting said drive motor and means on said support member for supporting a speed reduction drive unit interposed an output shaft of said drive motor and said sprocket for reducing the speed of rotation of said sprocket with respect to said output shaft.

19. The operator system set forth in claim 18 wherein:

said output shaft of said drive motor is engageable with gear means on said speed reduction drive unit and said drive module includes a retainer member for retaining said motor supported on said boss without imposing axial-directed forces on said output shaft when said output shaft is engaged with said gear means.

20. The operator system set forth in claim 19 including:

a motor capacitor mounted on said boss and retained thereon by said retainer.

21. The operator system set forth in claim 18 wherein:

said storage channel includes a first outer serpentine run including elongated spaced-apart parallel portions, a portion generally normal to said parallel portions and first and second switch-back portions for reversing the direction of said storage channel and a second inner serpentine channel portion formed on said support member within said first serpentine channel and including opposed parallel run portions and at least two switch-back portions.

22. The operator system set forth in claim 18 wherein:

said support member includes a guide channel extending between said sprocket and a transverse endwall of said support member and an integral projection formed on said support member and including a distal portion of said guide channel, said projection being adapted to engage a carriage member operably connected to said chain and to said door in response to rotation of said sprocket to pull said chain through said guide channel.

23. The operator system set forth in claim 18 including:

a generally rectangular frame plate releasably engageable with said support member including portions thereon for connecting said drive module to support structure for said operator system, said frame plate forming a closure for said storage channel for confining said chain therein.

24. The operator system set forth in claim 18 wherein:

said sprocket includes spaced apart teeth for engaging said chain, said teeth having a truncated height to enhance release of said chain from said sprocket.

* * * * *